US006062337A

United States Patent [19]

Zinserling

[11] Patent Number: 6,062,337

[45] Date of Patent: May 16, 2000

[54] AUDIO SYSTEM THAT CAN BE MOUNTED ON THE BODY OF A USER

[75] Inventor: Bert Zinserling, Bad Nauheim, Germany

[73] Assignee: Sennheiser electronic GmbH & Co. KG, Wedemark, Germany

[21] Appl. No.: 09/171,727

[22] PCT Filed: Feb. 10, 1997

[86] PCT No.: PCT/EP97/00605

§ 371 Date: Jan. 25, 1999

§ 102(e) Date: Jan. 25, 1999

[87] PCT Pub. No.: WO97/41709

PCT Pub. Date: Nov. 6, 1997

[30] Foreign Application Priority Data

Apr. 26, 1996 [DE] Germany ..... 196 16 870

[51] Int. Cl.[7] ..... H04R 25/00

[52] U.S. Cl. ..... 181/129

[58] Field of Search ..... 181/129, 130, 181/128; 381/370, 371, 376, 378, 382

[56] References Cited

U.S. PATENT DOCUMENTS

| | | | |
|---|---|---|---|
| 3,237,713 | 3/1966 | Leslie . | |
| 3,900,707 | 8/1975 | Hanson . | |
| 4,110,583 | 8/1978 | Lepper | 181/129 |

FOREIGN PATENT DOCUMENTS

| | | |
|---|---|---|
| 0 705 053 | 4/1996 | European Pat. Off. . |
| 32 14 080 | 10/1983 | Germany . |

*Primary Examiner*—Khanh Dang

*Attorney, Agent, or Firm*—McAulay Nissen Goldberg Kiel & Hand, LLP

[57] ABSTRACT

A sound reproduction arrangement having at least one sound transducer and a holding means carrying the at least one sound transducer, for support on the body of a user is disclosed. Such an arrangement has been known hitherto as a headset. The headset has two ear caps, in each of which is arranged at least one respective sound transducer. The headset is supported on the body of the user by virtue of it being fitted on to the head so that a respective ear cap bears with its open side directly on an ear of the user or encloses same, and thus the sound transducer or transducers disposed in the ear cap output the acoustic signals directly to the ear (the known headset would therefore in itself be more correctly identified as a |earphone|). It is characteristic of a headset that the left ear receives only the left audio signal and the right ear receives only the right audio signal of the headset. The disclosed sound reproduction arrangement makes it possible to achieve high-quality sound reproduction with improved spatial association, in particular in the case of multi-channel sound reproduction, in a structurally simple manner and without involving the need for a relatively large amount of space, without the installation problems which occur in relation to loudspeaker systems and without being influenced by the acoustics of the roan, while reproduction is also to be possible with relatively high sound volumes, without disturbing the environment. This is done by making the holding portion of such a configuration that it can be supported on a part of the body of the user, which is different from the head, and in that situation the at least one sound transducer can be positioned adjacent and at a spacing relative to the head of the user so that the head of the user remains freely movable with respect to the holding means and thus with respect to the at least one sound transducer.

15 Claims, 8 Drawing Sheets

AUDIO SYSTEM THAT CAN BE MOUNTED ON THE BODY OF A USER

BACKGROUND OF THE INVENTION a) Field of the Invention

The invention concerns a sound reproduction arrangement having at least one sound transducer and a holding means carrying the at least one sound transducer, for support on the body of a user.

b) Description of the Related Art

Such an arrangement has been known hitherto as a headset. The headset has two ear caps, in each of which is arranged at least one respective sound transducer. The headset is supported on the body of the user by virtue of it being fitted on to the head so that a respective ear cap bears with its open side directly on an ear of the user or encloses same, and thus the sound transducer or transducers disposed in the ear cap output the acoustic signals directly to the ear (the known headset would therefore in itself be more correctly identified as a 'earphone'). It is characteristic of a headset that the left ear receives only the left audio signal and the right ear receives only the right audio signal of the headset.

It is precisely in regard to the reproduction of multi-channel audio recordings by means of multi-channel headsets, in particular the reproduction of multi-channel Dolby-Surround coded music and film sound recordings, with a corresponding Dolby-Surround headset, that it has been found disadvantageous that precise spatial association of the multi-channel sound reproduction effect is unfortunately possible only with difficulty or is not possible at all, because of the above-described direct input of sound into the ears.

U.S. Pat. No. 3,900,707 discloses a sound reproduction arrangement in which the sound reproduction arrangement comprises a pillow which substantially surrounds the head of the user and into which a plurality of sound transducers are fitted. The pillow moves with the head, upon movement thereof.

German Patent DE-A-32 14 080 also discloses an arrangement for the reproduction of stereophonic, in particular head-related signals, in which two sound transducers are carried by a holder, and the holder is of such a configuration, for being supported on the body of the user, that it can be supported on the shoulder of the user, in which case the two sound transducers can be placed at a spacing relative to the head of the user so that the head of the user remains freely movable with respect to the holder and thus with respect to the sound transducers. The first of the two sound transducers is associated with the left ear of the user and the second sound transducer is associated with the right ear, and the two sound transducers lie laterally at the head of the user.

Admittedly, it is possible to achieve multi-channel sound reproduction with a better degree of spatial association by means of a suitable number of loudspeakers which are set up in a discretely distributed arrangement in a room; however such loudspeakers require a relatively high level of installation expenditure and take up a relatively high level of space, while the acoustics of the room have a considerable influence on the quality of sound reproduction, high sound volumes disturb the environment and not least high-quality systems are particularly expensive.

OBJECT AND SUMMARY OF THE INVENTION

SUMMARY OF THE INVENTION

Therefore the primary object of the present invention is so to develop the sound reproduction arrangement of the kind set forth in the opening part of this specification, that it is possible to achieve high-quality sound reproduction with improved spatial association, in particular in the case of multi-channel sound reproduction, in a structurally simple manner and without involving the need for a relatively large amount of space, without the installation problems which occur in relation to loudspeaker systems and without being influenced by the acoustics of the room, while reproduction is also to be possible with relatively high sound volumes, without disturbing the environment.

That object is attained by a sound reproduction arrangement having at least a first, second and third sound transducer, and holding means carrying the first, second and third sound transducer on the body of the user. The holding means are of a configuration such that it can be supported on a part of the body of the user, which is different from the head, and in that situation the sound transducers can be positioned adjacent and at a spacing from the head of the user so that the head of the user remains freely movable relative to the holding means and thus relative to the sound transducers. The first sound transducers being associated with the left ear and the second sound transducer being associated with the right ear. The third sound transducer is in front of the face of the head of the user.

It is typical of the construction according to the invention that the left-hand and the right-hand ear respectively can receive all reproduced channels so that the individual transmission function of the head of a user is incorporated into the reproduction. Thus, as is also the case when hearing in the natural environment, the direction of incidence of the sound is definitely determined by the person hearing the sound. That is also assisted by virtue of the fact that, with a stationary arrangement, it is possible to turn the head, which simplifies locating a sound source, as when naturally hearing a sound.

The construction according to the invention provides a so-called head-related sound reproduction arrangement insofar as, when the holding means is supported on the body of the user, the sound transducer or transducers themselves do not bear directly against the head but are arranged at a spacing relative thereto and thus permit a turning movement of the head, in which case the sound transducer or transducers does or do not also move with the head. Accordingly the structure according to the invention makes it possible to achieve a precise spatial association.

In addition, the overall transmission function of the head can be additionally utilised by virtue of the sound reproduction arrangement according to the invention while that is not possible in the case of headphones because headphones are in fact not 'headphones' but rather 'earphones' as the ear caps thereof bear directly on or enclose the ear and thus the sound transducers disposed therein output the acoustic signals directly to the ear. In comparison, in the case of the sound reproduction arrangement according to the invention, by virtue of the sound transducer or transducers being disposed at a spacing from the ear, the sound is also transmitted through the body, in addition to acoustically direct input of sound to the ear. In particular however due to the incorporation of the transmission function of the head of the user, the perception of sound appears to be 'more natural' from the point of view of the person listening to the sound.

Accordingly the sound reproduction arrangement according to the invention makes it possible to achieve a high-quality sound reproduction without demanding a large amount of space, without the installation problems which occur with loudspeaker systems and without being influenced by the acoustics of the room, wherein the user perceives an exact spatial location.

Finally the invention permits sound reproduction even with a very high level of sound volume sensation, without the environment and in particular neighbours being disturbed because the sound transducers are arranged very close to the ears of the user and therefore relatively low levels of sound pressure are already sufficient, at the reproduction transducer, to give the user a high sound volume impression.

Preferably the holding means may be designed in such a way that it can be simply laid on the shoulder of the user and thus fixed.

The sound reproduction arrangement according to the invention is suitable by virtue of its advantage of an improved spatial sound reproduction in particular for multi-channel reproduction, for example in the Dolby-Surround mode, for which purpose a plurality of sound transducers are then to be arranged on the holding means.

In a development of the multi-channel configuration preferably a respective pair of sound transducers should be arranged on the holding means in such a way that, when the holding means is supported on the body of the user, the pair of sound transducers is disposed in front of and/or behind the frontal plane of a co-ordinate system related to the head of the user, in which respect desirably the one sound transducer of a pair is disposed on one side of the central plane of the co-ordinate system related to the head of the user and the other sound transducer is arranged on the other side of said plane.

In another development of the multi-channel construction, at least one additional sound transducer can be arranged on the holding means in such a way that, when the holding means is supported on the body of the user, the additional sound transducer is in front of the head of the user and can preferably be positioned between the two sound transducers and in particular in the central plane of the co-ordinate system which is related to the head of the user. That additional sound transducer should be provided as a centre channel in particular in the case of a Dolby-Surround system.

In addition at least one additional bass sound transducer can be arranged on the holding means, more specifically preferably in such a way that, when the holding means is supported on the body of the user, it is disposed behind the head of the user and in particular in the central plane of the co-ordinate system which is related to the head of the user. As it is not possible to associate a definite direction to a low-frequency signal, for psycho-acoustic reasons, reproduction by way of a bass sound transducer is adequate. In addition that measure reduces the weight of the arrangement. The transmission range of the bass sound transducer should desirably be below 200 to 400 Hz.

In a preferred development the holding means may have acoustic conduits which, when the holding means is supported on the body of the user, lead from the bass sound transducer to the two ears of the user and preferably terminate beneath same. In that way the low-frequency sound component generated by the bass sound transducer is conducted to both ears. A development which is particularly desirable from the structural point of view in that respect is distinguished in that the holding means comprises a shaped body in which the acoustic conduits are contained.

The environment is not polluted with deep sounds due to the acoustic short-circuit occurring between the acoustic conduits and the diaphragm of the bass sound transducer.

Finally the holding means itself should comprise sound-damping material so that it is not itself caused to vibrate and thus uncontrolledly contributes to sound reproduction.

The invention is described in greater detail hereinafter with reference to the accompanying drawings.

DESCRIPTION OF THE PREFERRED EMBODIMENTS

Figure 1:
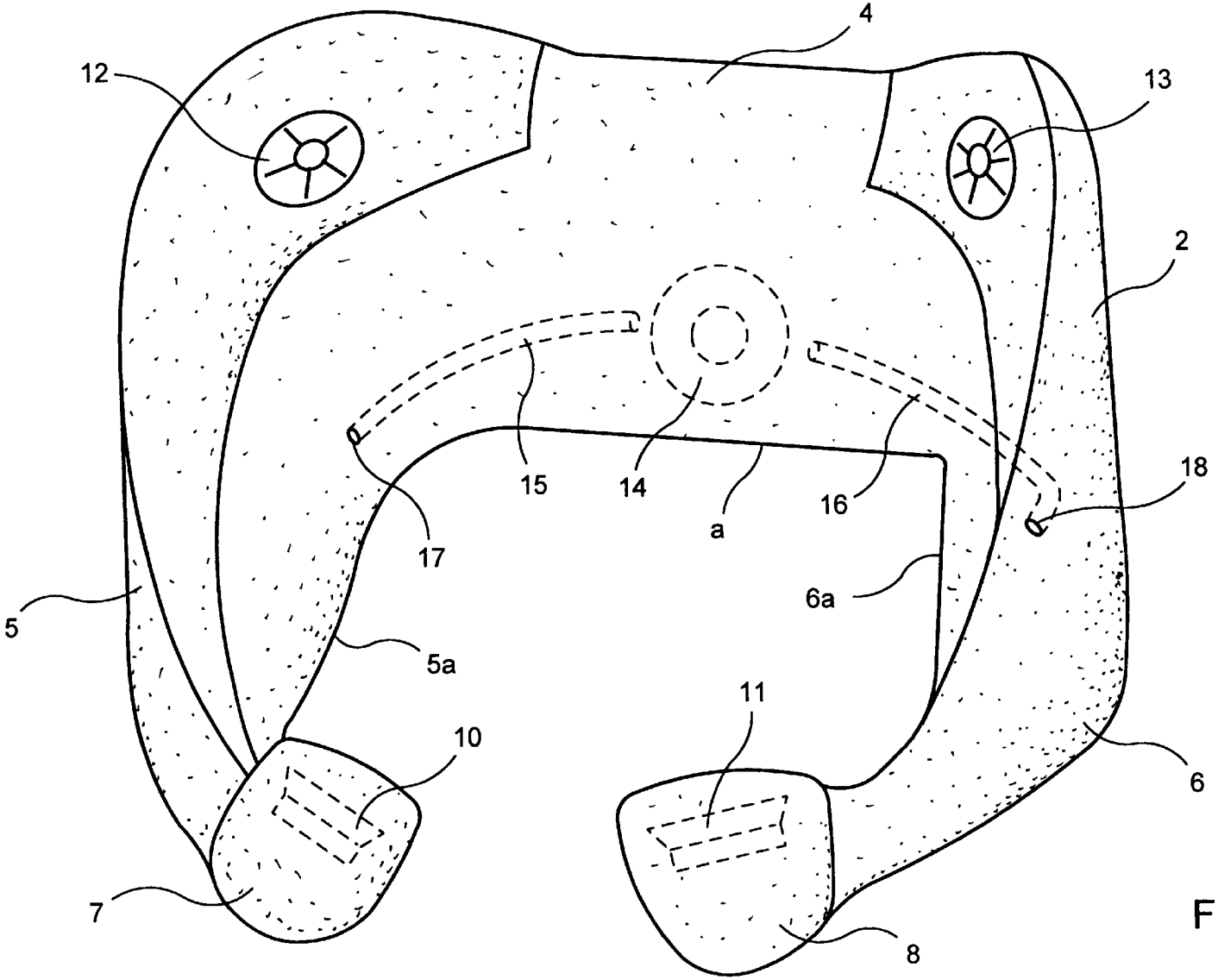
FIG. 1 is a perspective view of a first embodiment of the sound reproduction arrangement.

The first embodiment of the sound reproduction arrangement as shown in FIG. 1 has a frame structure 2 comprising a rear portion 4 and two curved side portions 5 and 6 which adjoin the rear portion 4 at both sides thereof and which terminate in free end portions 7 and 8. The frame structure 2 is thus in the form of a shaped body which in plan view (see FIG. 2) is substantially in the shape of an interrupted 'Q' or a 'U' with inwardly bent free ends.

Arranged in the frame structure 2 of the structure shown in FIG. 1 are front first and second sound transducers 10 and 11, rear third and fourth sound transducers 12 and 13 and a rear bass sound transducer 14. Accordingly the frame structure 2 serves to hold the sound transducers 10 to 14. The sound transducers 10 to 14 form a multi-channel Dolby-Surround reproduction system, wherein the front first and second sound transducers 10 and 11 are provided as main transducers for reproduction of the front right and left information and the rear third and fourth sound transducers 12 and 13 are provided as rearward transducers for reproduction of the additional spatial information (surround channel), while the rear bass sound transducer 14 reproduces the low-frequency component. The frame structure 2 also includes two acoustic conduits 15 and 16 of which the one acoustic conduit 15 extends from the rear bass sound transducer 14 into the one side portion 5 and terminates there adjacent to the rear third sound transducer 12 in an exit opening 17 arranged at the inside and the other acoustic conduit 16 extends from the rear bass sound transducer 14 into the other side portion 6 and terminates there adjacent to the rear fourth sound transducer 13 also in an inwardly opened exit opening 18.

For acoustic reasons the sound transducers 10 to 14 are arranged in sunk relationship so as to avoid edges which otherwise give rise to sound reflection effects and therewith also interference phenomena with the sound which is radiated directly from the sound transducer.

The first to fourth sound transducers 10 to 13 are so oriented that they output the sound through openings (not shown) suitably provided at the inside of the frame structure 2, into the internal space enclosed by the frame structure 2, wherein the frame structure 2 is covered at least at those openings, but preferably in its entirety, by a textile layer (not shown) which however is not absolutely necessary. The frame structure 2 itself comprises a high-damping material so that it itself does not contribute to sound production and conduction. In addition the rear bass sound transducer 14 and the associated acoustic conduits 15 and 16 are of such an arrangement and configuration that essentially a respective acoustic short-circuit in respect of the low-frequency sound components results between the exit openings 17 and 18 of the acoustic conduits 15 and 16 and the rear exit opening of the bass sound transducer 14.

While in FIG. 1 the frame structure 2 is in the form of a shaped body, it is however also possible to envisage other constructions for holding the sound transducers 10 to 14 and for providing the acoustic conduits 15 and 16. If desired it is also possible to omit the acoustic conduits 15 and 16; that naturally also applies in principle in regard to the number and configuration of the individual sound transducers.

Figure 2:
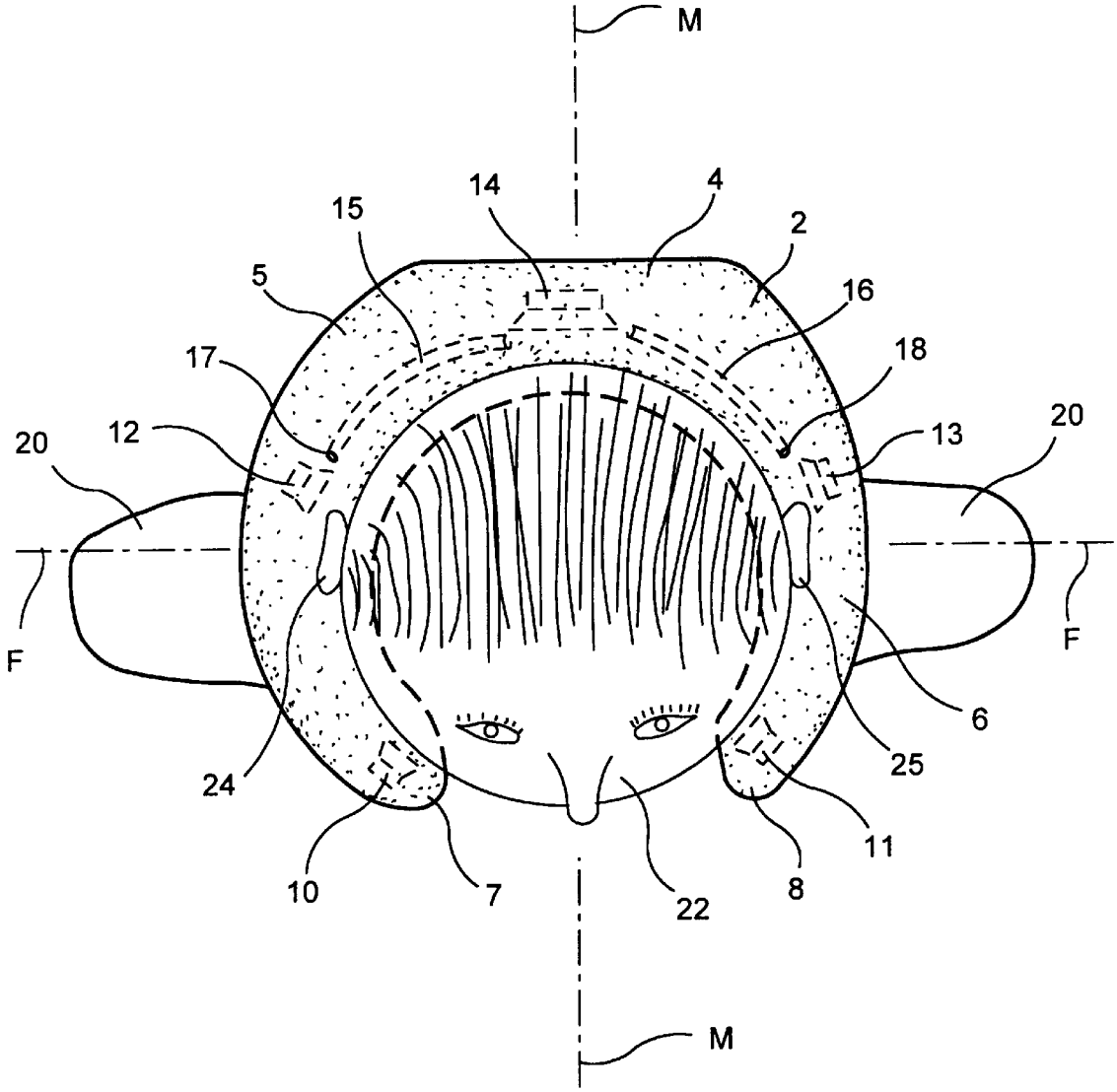
FIG. 2 is a plan view of the construction shown in FIG. 1 (supported on the shoulders of a user)
Figure 3:
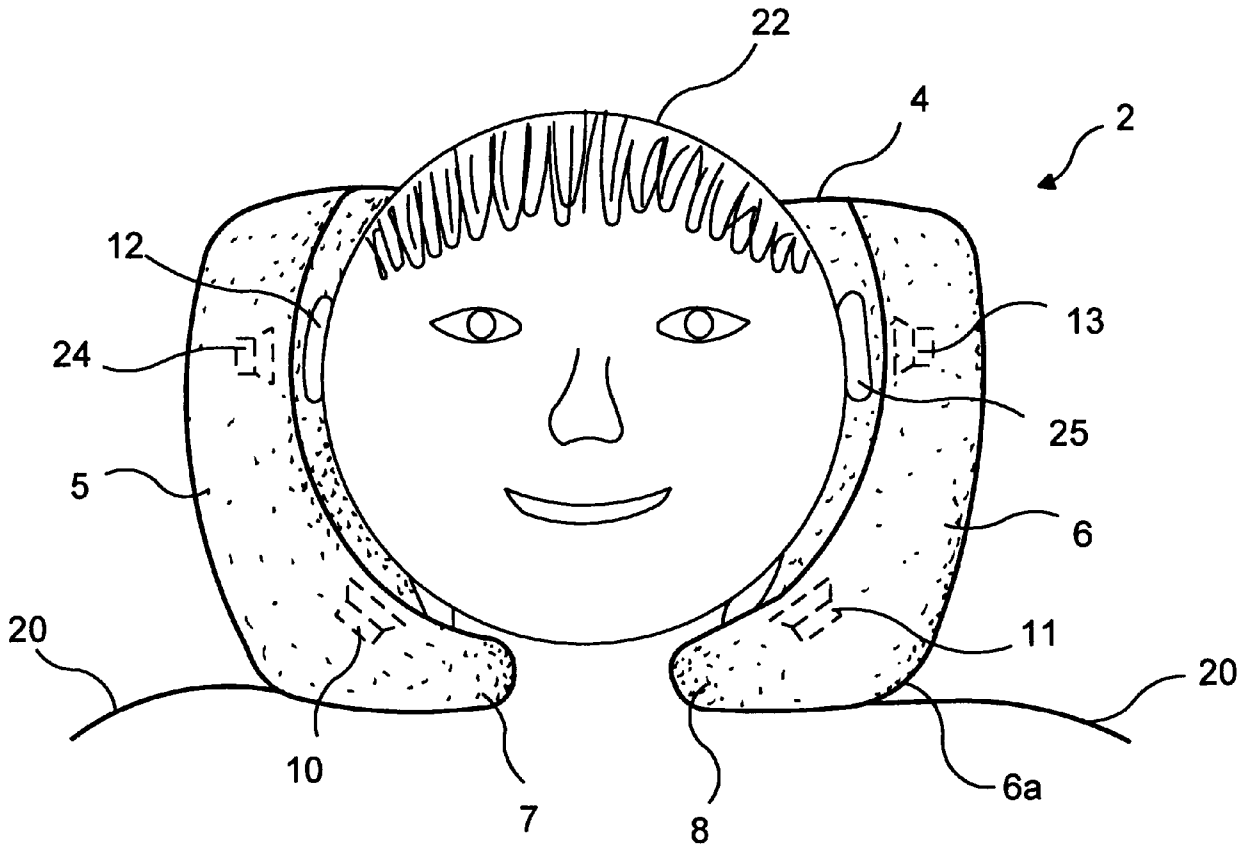
FIG. 3 is a front view of the structure shown in FIG. 1 (supported on the shoulders of a user)

FIGS. 2 and 3 now shows how the above-described embodiment of the sound reproduction arrangement is supported on the body of a user. The frame structure 2 serves not only for arranging the sound transducers 10 to 14 but also for supporting that arrangement of sound transducers on the body of a user, by virtue of the fact that it lies with the undersides 5a and 6a of the side portions 5 and 6 (see FIG. 1) on the shoulders 20 of the user while it is supported with the underside 4a of the rear portion 4 (see FIG. 1) on the back (not shown) of the user. The frame structure 2 is of such a configuration and can be so laid and fixed on the shoulders 2 and possibly the back of the user that the frame structure 2 is at a small spacing relative to the head 22 of the user and thus the head 22 remains freely movable. Alternately however the frame structure may also be of such a design configuration that it can be supported on another part of the body. The only important consideration in that respect is that it can be supported on a part of the body of the user, which is different from the head 22, so that the head 22 remains freely movable with respect to the frame structure 2 and thus with respect to the sound transducers 10 to 14 arranged therein, and the exit openings 17 and 18 of the acoustic conduits 15 and 16. As FIGS. 1 to 3 show, the frame structure 2 of the embodiment illustrated therein is in the form of a collar when it is supported on the shoulders 20 of the user. The described sound reproduction arrangement can therefore also be referred to as a 'listening collar'.

The support configuration is preferably such that the centre of gravity of the support configuration occurs centrally in the support contact surface between the shoulders of the user. Weights 7 and 8 can possibly be provided for that purpose (not shown).

In addition, the sound transducers 10 to 14 and the exit openings 17 and 18 of the acoustic conduits 15 and 16 are so arranged in the frame structure 2 that, when the frame structure 2 is supported on the body of the user, the front first and second sound transducers 10 and 11 are arranged in front of the frontal plane F of a co-ordinate system related to the head 22 of the user, in the region of the chin, below the ear level, and the rear third and fourth sound transducers 12 and 13 are behind the frontal plane F, and the exit openings 17 and 18 of the acoustic conduits 15 and 16 are arranged somewhat below the ears 24 and 25 while the rear bass sound transducers 14 is disposed behind the head 22, as FIGS. 2 and 3 show. In addition the front first and second sound transducers 10 and 11 and the rear third and fourth sound transducers 12 and 13 are respectively arranged symmetrically with respect to the central plane M of the co-ordinate system related to the head 22 of the user, while the rear bass sound transducers 14 is disposed in the central plane M, as FIG. 2 also shows.

Accordingly, the described sound reproduction arrangement forms a head-related multi-channel reproduction system. The sound transducers 10 to 14 are arranged around the head 22, in which respect they themselves do not bear directly against the head 22 but are arranged at an at least slight spacing therefrom and therefore do not move with the head 22 when it is turned. The head 22 of the user is therefore free, which means that spatial reproduction is made possible, as in the case of loudspeaker boxes which are set up in a room. By virtue of the spatial spacing of the sound transducers from the ears 24 and 25, the transmission function of the head of the user is incorporated into the sound field, and sound is also conducted through the solid material of the body, so that perception of the reproduced sound sounds 'more natural' from the point of view of the user.

Figure 4:
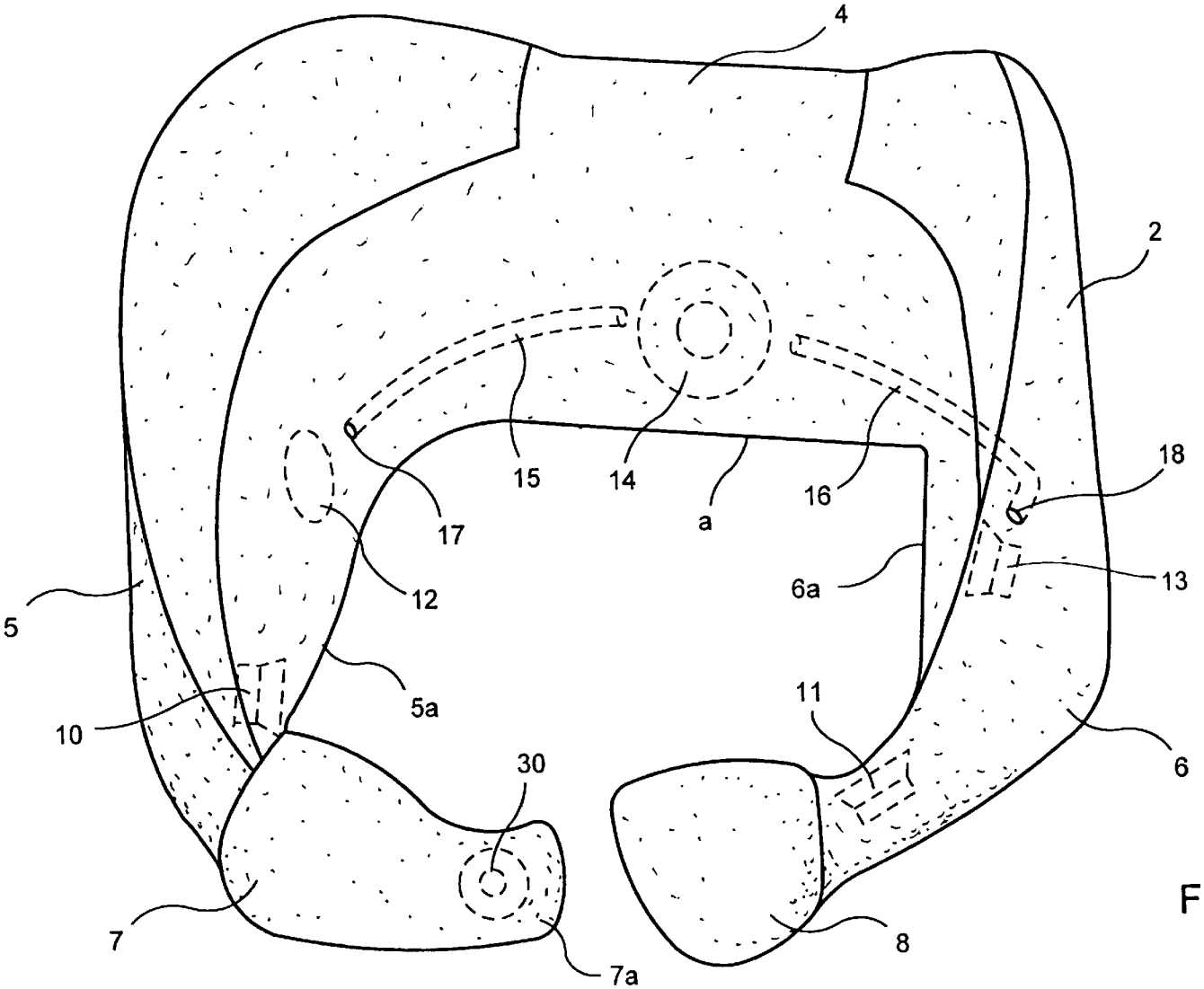
FIG. 4 shows a second embodiment of the sound reproduction arrangement.
Figure 5:
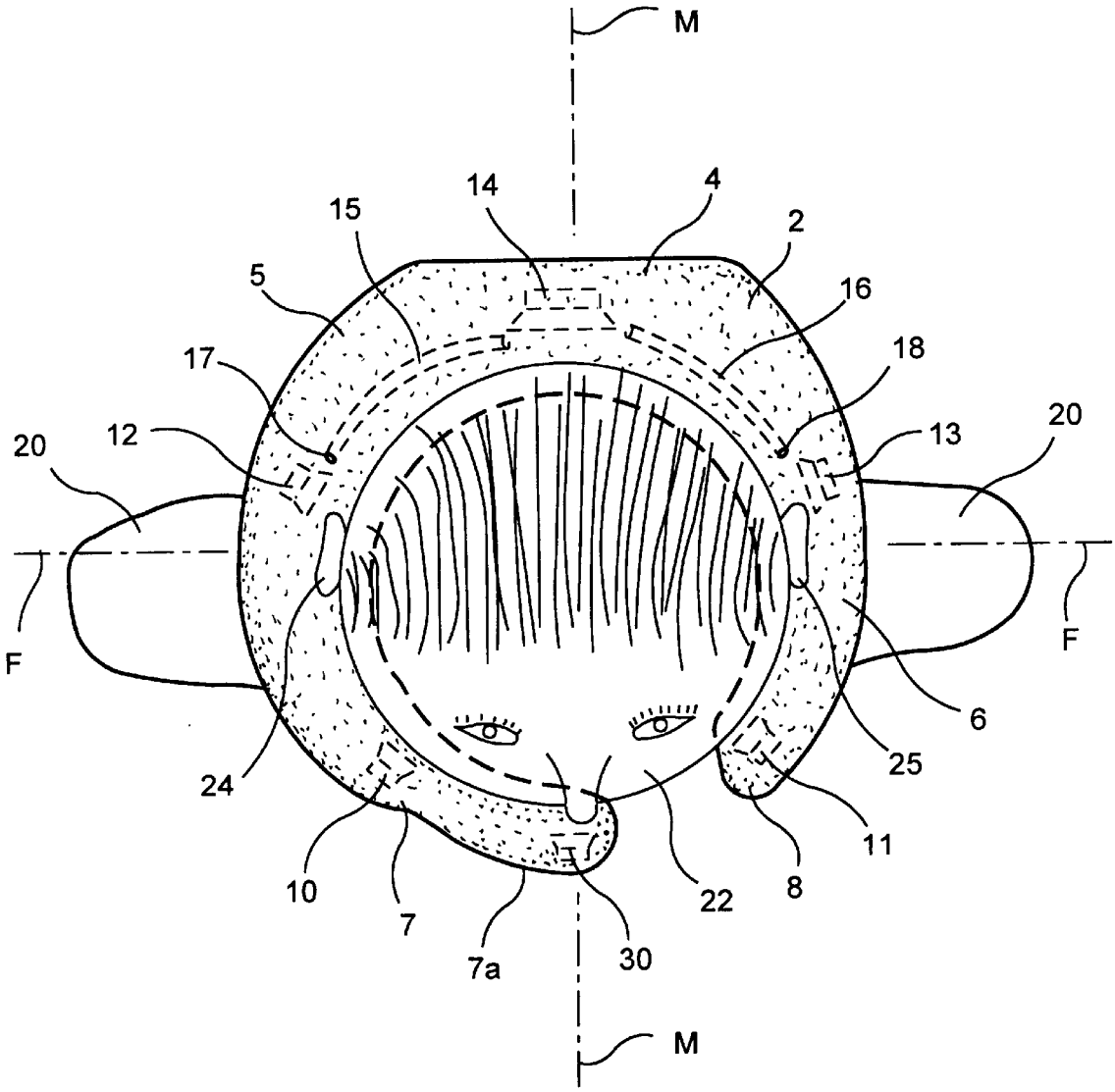
FIG. 5 is a plan view of the structure shown in FIG. 4 (supported on the shoulders of a user)
Figure 6:
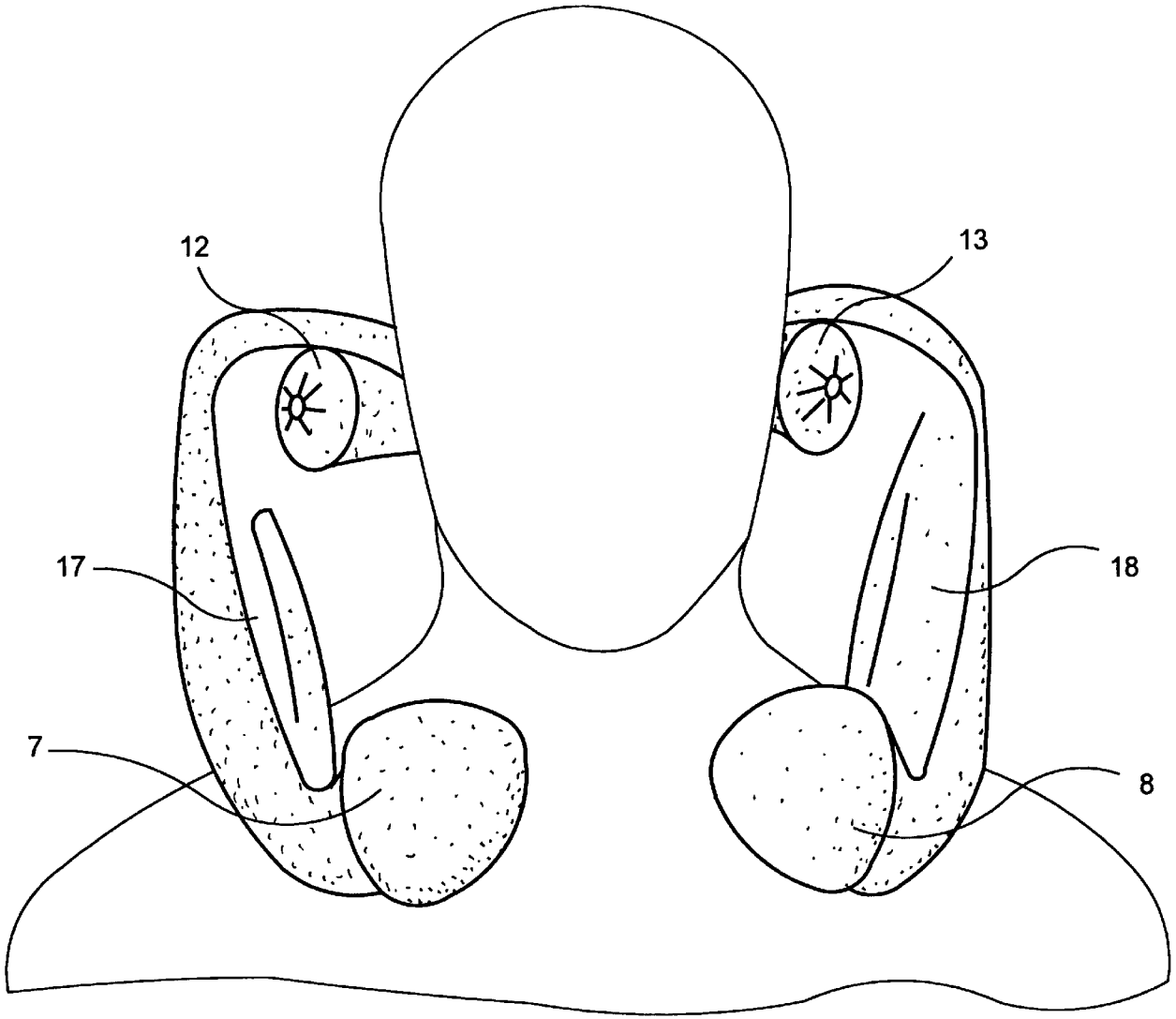
FIG. 6 is a front view of the sound reproduction arrangement.
Figure 7:
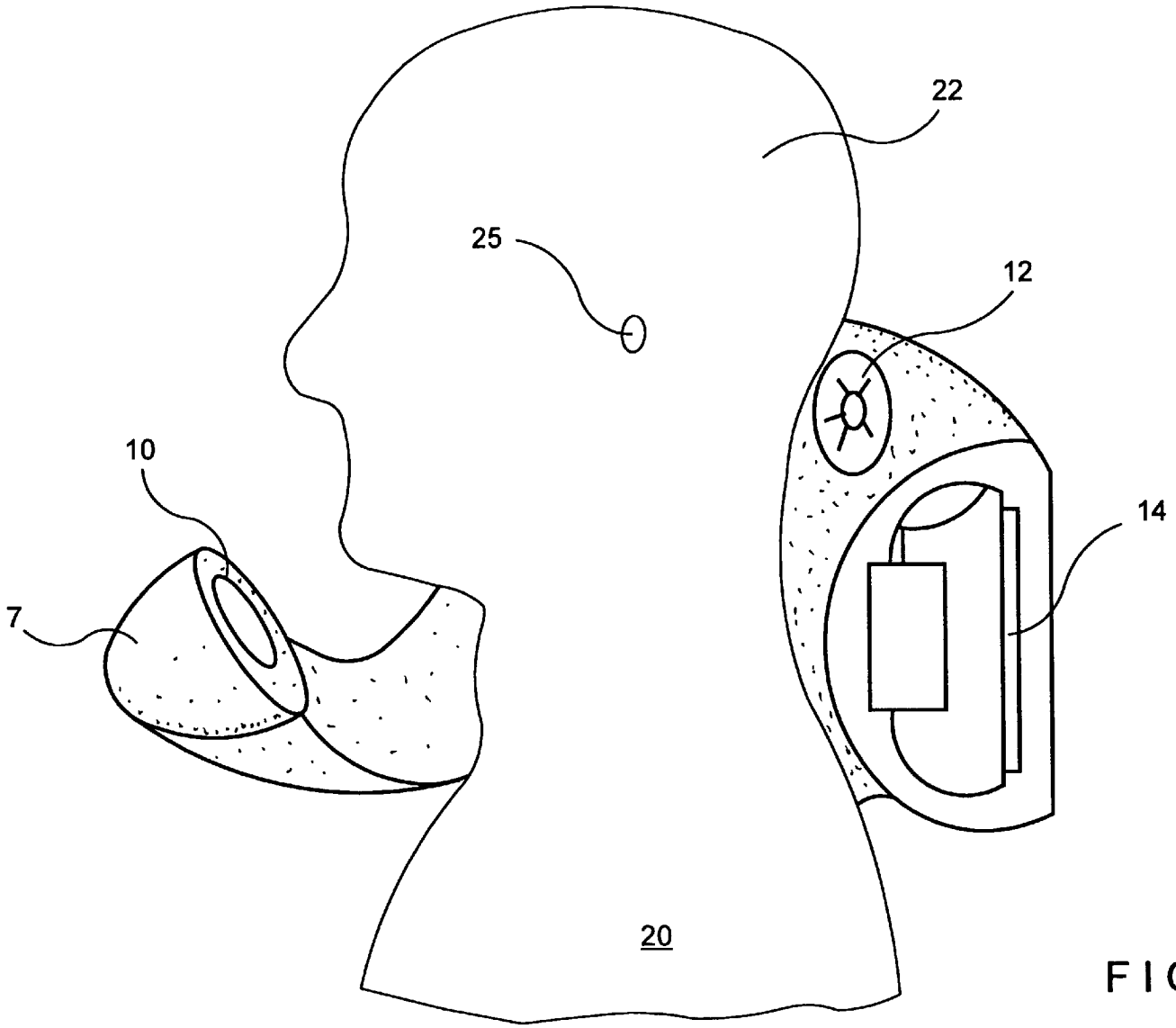
FIG. 7 is a side view in partial section through the sound reproduction arrangement.
Figure 8:
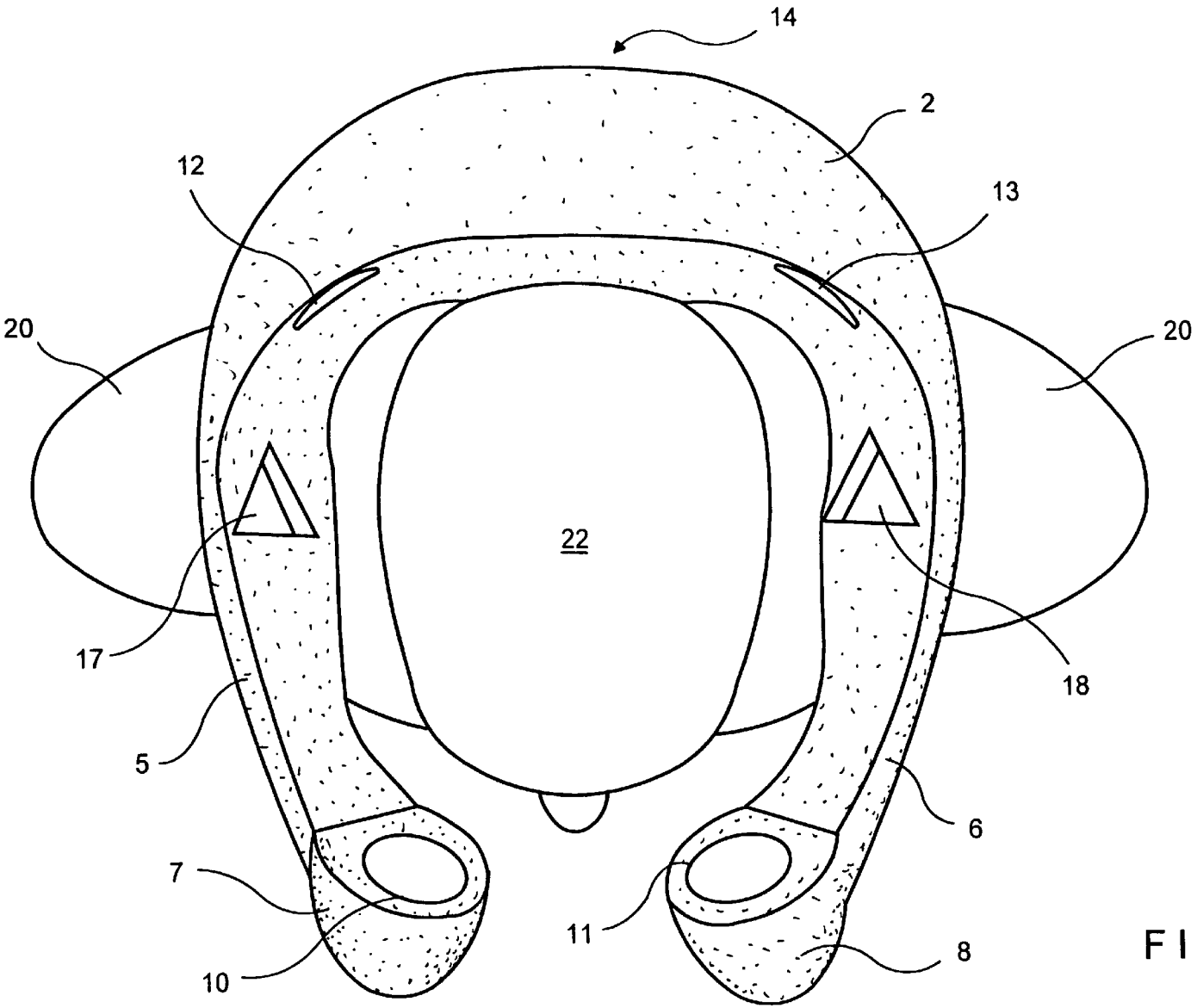
FIG. 8 is a view from above of the sound reproduction arrangement.

FIGS. 4 and 5 show a second embodiment of the sound reproduction arrangement, which differs from the first embodiment shown in FIGS. 1 to 3 in that there is additionally provided a front sound transducer 30 which, when the frame structure 2 is supported on the shoulders 20 of the user, is approximately in the central plane M in the region of the chin of the user. To support that additional sound transducer 30, the end portion 7, in comparison with the first embodiment, is provided with an extension portion 7*a* and is correspondingly prolonged, or the arrangement is closed in a forward direction (in an O-shape).

While the foregoing description and drawings represent the present invention, it will be obvious to those skilled in the art that various changes may be made therein without departing from the true spirit and scope of the present invention.

What is claimed is:

1. A sound reproduction arrangement for multi-channel sound reproduction, comprising:

at least three sound transducers; and holding means carrying said sound transducers for support on the body of the user;

said holding means being of a configuration such that it can be support on a part of the body of the user, which is different from the head, and in that situation the sound transducers can be positioned and at a spacing from the head of the user so that the head of the user remains freely movable relative to the holding means and thus relative to the sound transducers, and a first sound transducer being associated with the left ear and a second sound transducer being associated with the right ear, and at least one third sound transducer being in front of the face of the user.

2. The sound reproduction arrangement according to claim 1 wherein the sound transducer in front of the face of the user is arranged approximately at the level of the mouth part or therebelow.

3. The sound reproduction arrangement according to claim 1 wherein two sound transducers are so arranged that they are in front of the head of the user, wherein one sound transducer is arranged to the left and the other sound transducer is arranged to the right of the central plane and the sound transducers are arranged approximately at chin level in front of the face of the user.

4. The sound reproduction arrangement according to claim 1, wherein said sound transducer or transducers in front of the head of the user is or are about 10 cm or more in front of the frontal plane of a co-ordinate system related to the head of the user.

5. The sound reproduction arrangement according to claim 1 wherein four sound transducers are arranged on the holding means, of which two are so arranged that they are in front of the face of the user and a further two are so arranged that they come to bear in the immediate proximity of the ears of the user.

6. The sound reproduction arrangement according to claim 4 wherein a pair of sound transducers is arranged on the holding means in such a way that when on the body of the user said pair is disposed behind the frontal plane of a co-ordinate system related to the head of the user.

7. The sound reproduction arrangement according to claim 5 wherein the sound transducer of a pair is arranged on one side of the central plane of the co-ordinate system related to the head of the user and the other sound transducer is arranged on the other side of said central plane.

8. The sound reproduction arrangement according to claim 7 wherein the sound transducers can be positioned symmetrically relative to the central plane.

9. The sound reproduction arrangement according to claim 4 wherein at least one additional sound transducer is arranged on the holding means in such a way that when the holding means is supported on the body of the user, the additional sound transducer is disposed in front of the head of the user approximately in the central plane.

10. The sound reproduction arrangement according to claim 4 wherein at least one additional bass sound transducer is arranged on the holding means.

11. The sound reproduction arrangement according to claim 10 wherein the additional bass sound transducer is arranged on the holding means in such a way that when the holding means is supported on the body of the user the bass sound transducer is behind the head thereof.

12. The sound reproduction arrangement according to claim 11 wherein the additional bass sound transducer lies in the central plane of the co-ordinate system related to the head of the user.

13. The sound reproduction arrangement according to claim 10 wherein the holding means has acoustic conduits which, when the holding means is supported on the body of the user, lead from the bass sound transducer to the two ears of the user and preferably terminate beneath same.

14. The sound reproduction arrangement according to claim 13 wherein the holding means comprises a shaped body in which the acoustic conduits are contained.

15. The sound reproduction arrangement according to claim 1 wherein the holding means comprises sound-damping material.

* * * * *